US005331944A

United States Patent [19]

Kujawa et al.

[11] Patent Number: 5,331,944

[45] Date of Patent: Jul. 26, 1994

[54] VARIABLE SPEED INDUCER MOTOR CONTROL METHOD

[75] Inventors: Matthew Kujawa, Danville; Kevin D. Thompson, Indianapolis, both of Ind.

[73] Assignee: Carrier Corporation, Syracuse, N.Y.

[21] Appl. No.: 89,791

[22] Filed: Jul. 8, 1993

[51] Int. Cl.[5] ..... F24H 3/02

[52] U.S. Cl. ..... 126/110 R; 126/116 A

[58] Field of Search ..... 126/116 A, 116 B, 110 R

[56] References Cited

U.S. PATENT DOCUMENTS 4,703,747 11/1987 Thompson .

4,729,207 3/1988 Dempsey .

*Primary Examiner*—Carroll B. Dority

[57] ABSTRACT

In a fixed-firing rate induced draft furnace, having a heat exchanger and an integrated control inducer motor, an improved method of controlling excess air comprising the steps of: providing at least one pressure switch that is responsive to a preselected pressure drop level in the heat exchanger, the pressure drop level being selected so as to be commensurate with a theoretically desired excess air level under firing operating conditions; accelerating the integrated control inducer motor until the pressure switch closes and thereupon recording a first motor speed and a first current level; calculating a first torque value based on the first motor speed and the first current level; and regulating torque applied to the integrated control inducer motor in accordance with the first torque value.

6 Claims, 7 Drawing Sheets

VARIABLE SPEED INDUCER MOTOR CONTROL METHOD

BACKGROUND OF THE INVENTION

This invention relates generally to gas furnaces and more particularly to the operation of a smart inducer motor so as to provide constant combustion air flow regardless of various conditions both external to and internal to a induced-draft gas furnace.

In the operation of an induced-draft gas-fired furnace, combustion efficiency can be optimized by maintaining the proper ratio of the gas input rate and the combustion air flow rate. Generally, the ideal ratio is offset somewhat for safety purposes by providing for slightly more combustion air (i.e., excess air) than that required for optimum combustion efficiency conditions. In order that furnace heat losses are minimized, it is important that this excess air level is controlled.

In practice, the rate of combustion air flow is affected by a number of factors including vent length, furnace size, and wind conditions. Although furnace size may be predetermined at the factory, vent length is commonly not known until actual installation time, and wind conditions are normally highly variable during operation of the furnace. Additional conditions such as partial blockages by debris of various kinds can also affect combustion air flow rate while the furnace is in operation.

In addition, a large number of different furnace models are commonly in use at present, and it is highly desirable to provide a method which can be adapted to both a variety of different furnace models currently in use, as well as those that may be manufactured in the future. More specifically, it is desired to have a method of providing excess air control in both two stage and single stage products, as well as in both condensing and mid-efficiency furnaces.

Finally, different benefits may be derived from using the method of this invention depending upon the nature of the furnace in which it is used. Such benefits include the possibility of increased efficiency, lower operating cost, a higher degree of flexibility as to mode of installation, and less noise.

OBJECTS AND SUMMARY OF THE INVENTION

It is therefore an object of the present invention to provide an improved method for controlling the rate of combustion air flow in a gas-fired furnace without the need for field-tuning the combustion system.

It is another object of the present invention to provide a method of excess air control in furnaces that is independent of furnace size, vent length, and wind conditions.

It is a further object of the present invention to provide a method of excess air control in furnaces that is applicable to both two stage and single stage products.

It is yet another object of the present invention to provide a method of excess air control in furnaces that is applicable to both condensing and mid-efficiency furnaces.

It is still another object of the present invention to provide a method of excess air control in furnaces that uses a smart inducer motor.

Still another object of the present invention is to reduce the complexity of the main furnace control in a two-stage induced-draft furnace.

Yet another object of the present invention is to provide improved combustion efficiency in a single stage induced-draft furnace.

It is a further object of the present invention to allow down-sizing the vent system diameter.

It is yet another object of the instant invention to allow side wall venting in a mid-efficiency induced-draft furnace.

It is still another object of the instant invention to reduce burner startup noise volume in a mid-efficiency induced-draft furnace.

These and other objects of the present invention are attained by, in a fixed-firing rate induced draft furnace, having a heat exchanger and an integrated control inducer motor, an improved method of controlling excess air comprising the steps of: providing at least one pressure switch that is responsive to a preselected pressure drop level in the heat exchanger, the pressure drop level being selected so as to be commensurate with a theoretically desired excess air level under firing operating conditions; accelerating the integrated control inducer motor until the pressure switch closes and thereupon recording a first motor speed and a first current level; calculating a first torque value based on the first motor speed and the first current level; and regulating torque applied to the integrated control inducer motor in accordance with the first torque value.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

The instant invention may be applied generally to fixed-firing rate induced draft gas furnaces. Depending upon the type of furnace involved, different advantages are obtainable, as will be discussed hereinafter. However, for a better understanding of its operation, its use in conjunction with a two stage condensing furnace is described. U.S. Pat. No. 4,729,207 to Dempsey et al. assigned to a common assignee, teaches a method of air flow regulation for an Electronically Commutated Motor (ECM). The teachings of the 4,729,207 patent are herein incorporated by reference as these teachings relate to the instant invention which applies to an Integrated Control Motor (ICM). The ICM has electronics built into the motor and is controlled by the software therein, and is thus a "smart" inducer motor, while the ECM is a two-piece design controlled by electronic hardware.

Figure 1:
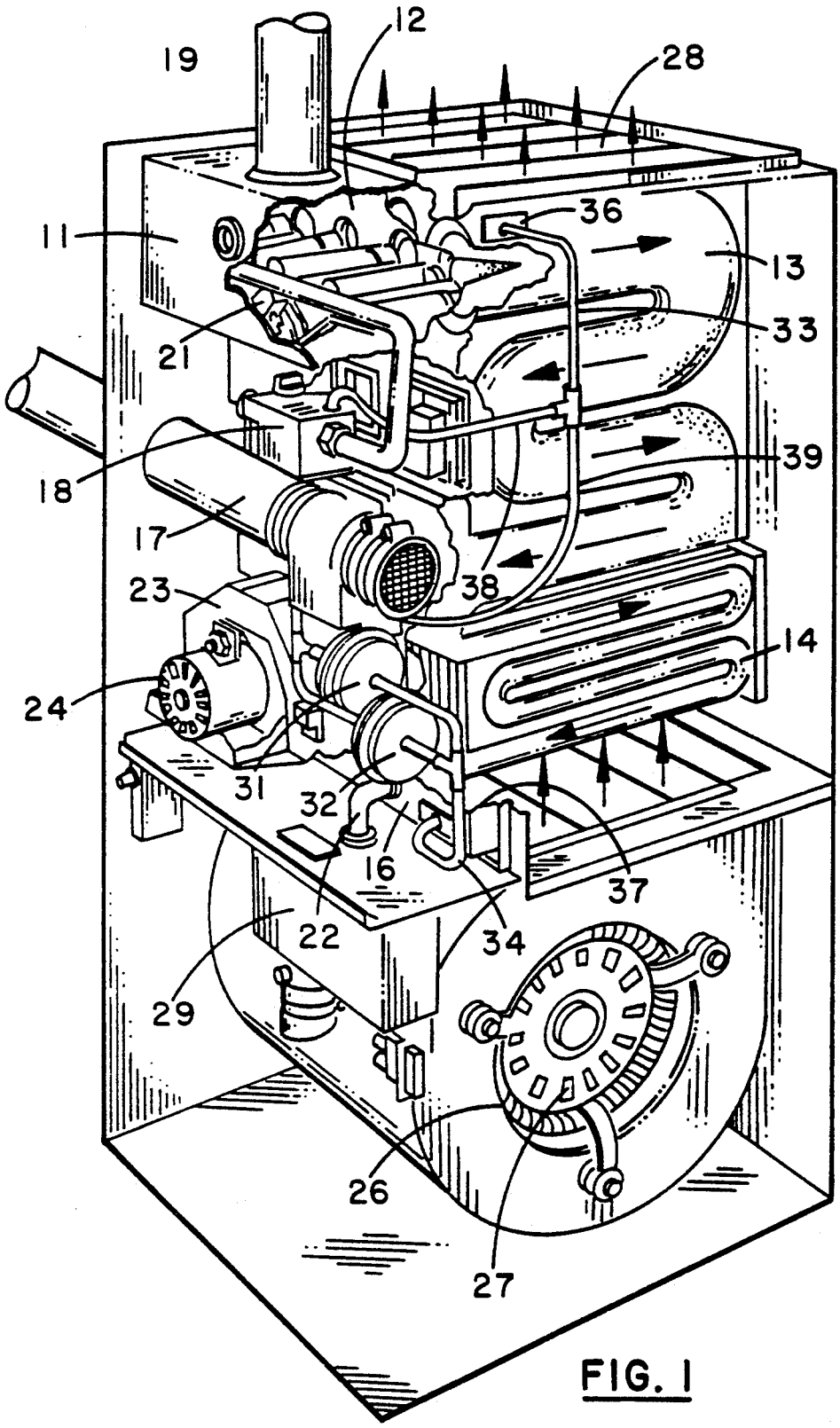
FIG. 1 is a perspective view of a gas furnace having the present invention incorporated therein.

Referring now to FIG. 1, there is shown a furnace of one of the general types with which the present invention can be employed, namely a two-stage condensing furnace. A burner assembly 11 communicates with a burner box 12 of a primary heat exchanger 13. Fluidly connected at the other end of the primary heat exchanger 13 is a condensing heat exchanger 14 whose discharge end is fluidly connected to a collector box 16 and an exhaust vent 17. In operation, gas valve 18 meters the flow of gas to the burner assembly 11 where combustion air from the air inlet 19 is mixed and ignited by the ignition assembly 21. The hot gas is then passed through the primary heat exchanger 13 and the condensing heat exchanger 14, as shown by the arrows. The relatively cool exhaust gases then pass through the collector box 16 and the exhaust vent 17 to be vented to the atmosphere, while the condensate flows from the collector box 16 through a condensate drain line 22 from where it is suitably drained to a sewer collection or the like. Flow of the combustion air into the air inlet 19 through the heat exchangers 13 and 14, and the exhaust vent 17, is enhanced by a draft inducer blower 23 which is driven by an ICM inducer motor 24 in response to control signals from the microprocessor and pressure switches 31 and 32 contained therein.

The household air is drawn into a blower 26 which is driven by a drive motor 27, in response to signals received from either its own internal microprocessor, or the system microprocessor contained in the microprocessor control assembly 29, or a combination of both. The discharge air from the blower 26 passes over the condensing heat exchanger 14 and the primary heat exchanger 13, in counterflow relationship with the hot combustion gases, to thereby heat up the household air, which then flows from the discharge opening 28 to the duct system within the home.

The ICM microprocessor mentioned hereinabove is contained as part of the ICM inducer motor 24. In response to electrical signals from the pressure switches 31 and 32, and from other signals to be discussed hereinafter, the ICM microprocessor operates to control the ICM inducer motor 24 while the blower motor 27 is controlled as described above, operating together in such a way as to promote an efficient combustion process at different firing rates.

Figure 2:
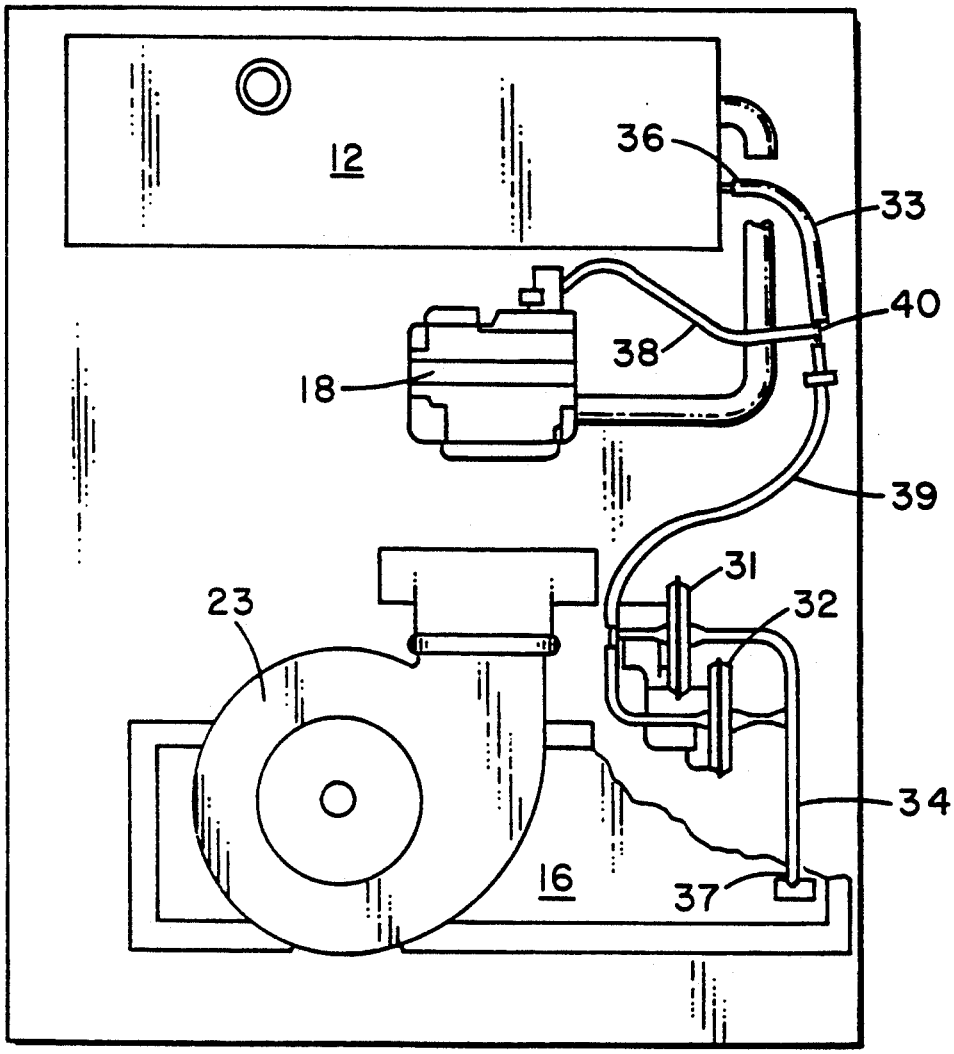
FIG. 2 is a schematic illustration of the two installed pressure switches thereof as applied to the heat exchanger system.
Figures 3, 3A:
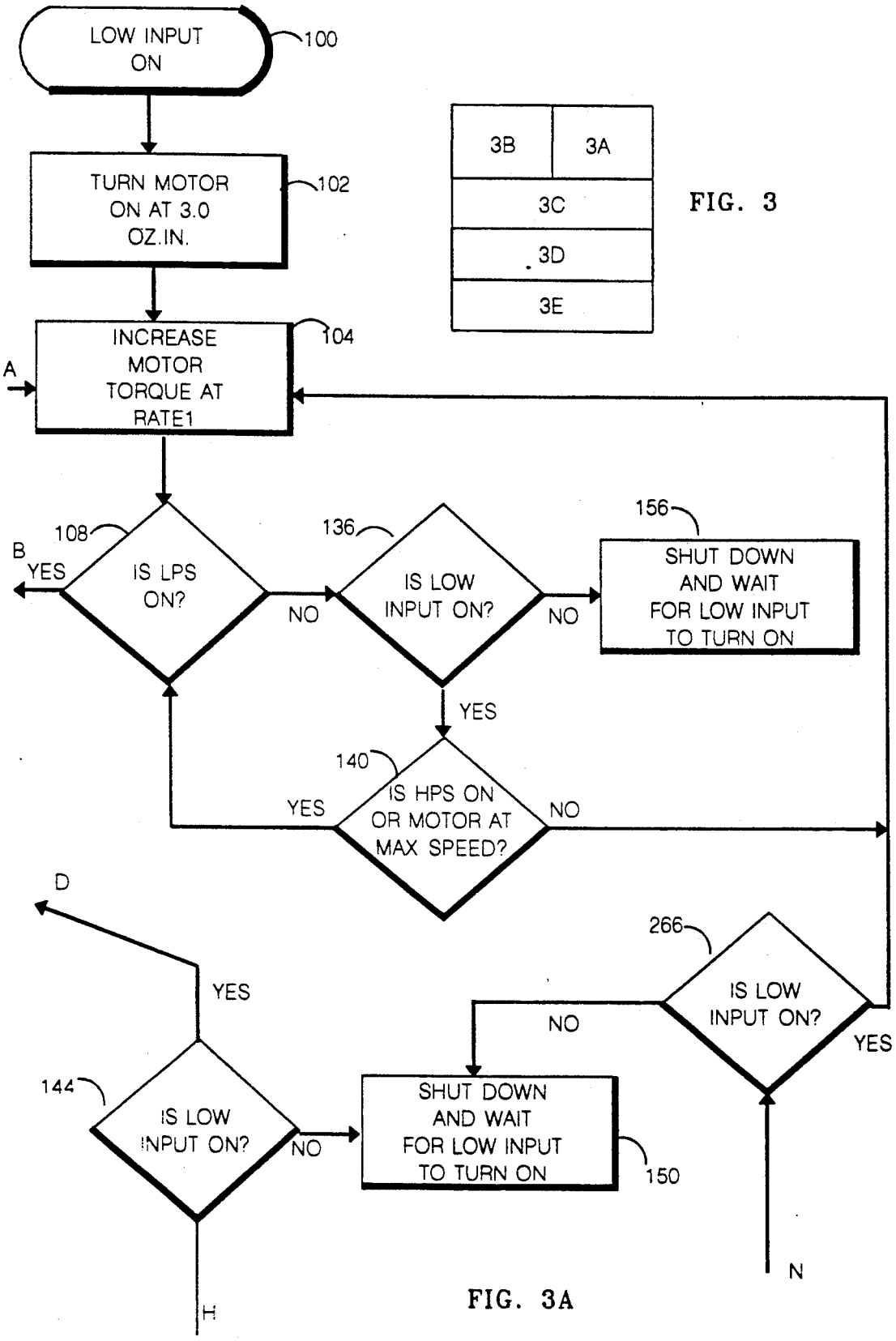
FIGS. 3 and 3*a*–3*e* comprise a flow chart illustrating the operation of one embodiment of the invention, that being in a two stage furnace.
Figure 3B:
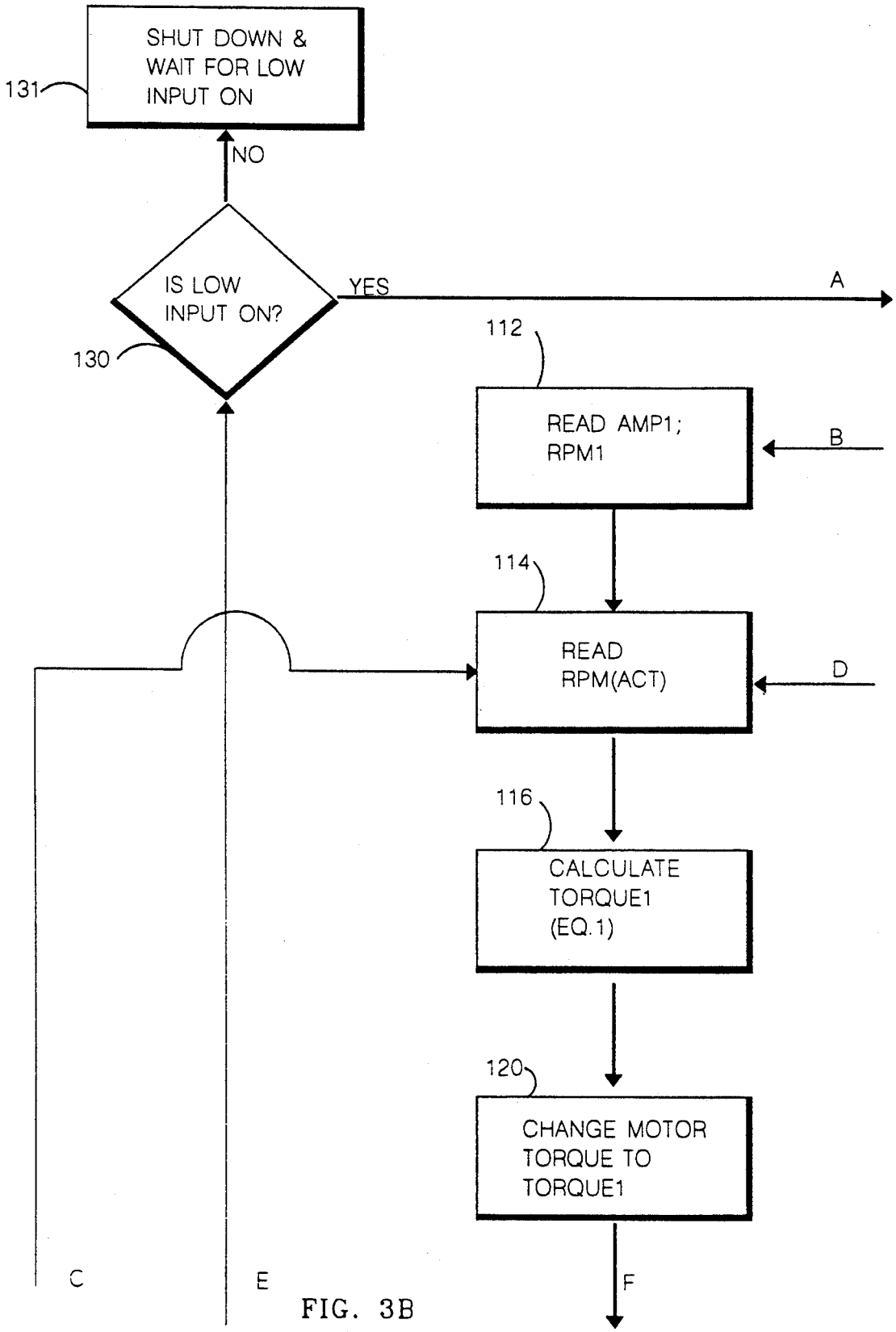
Figure 3C:
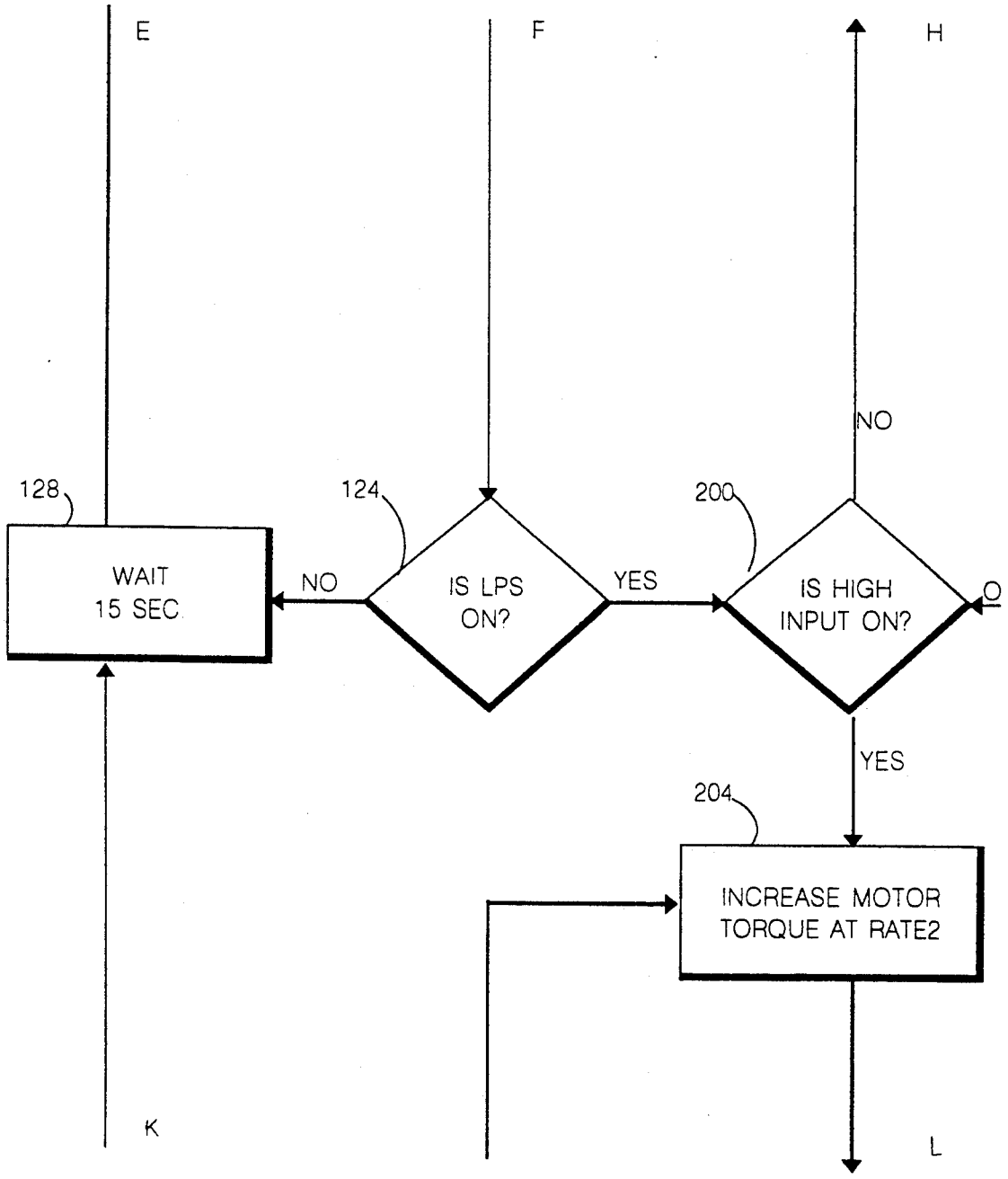
Figure 3D:
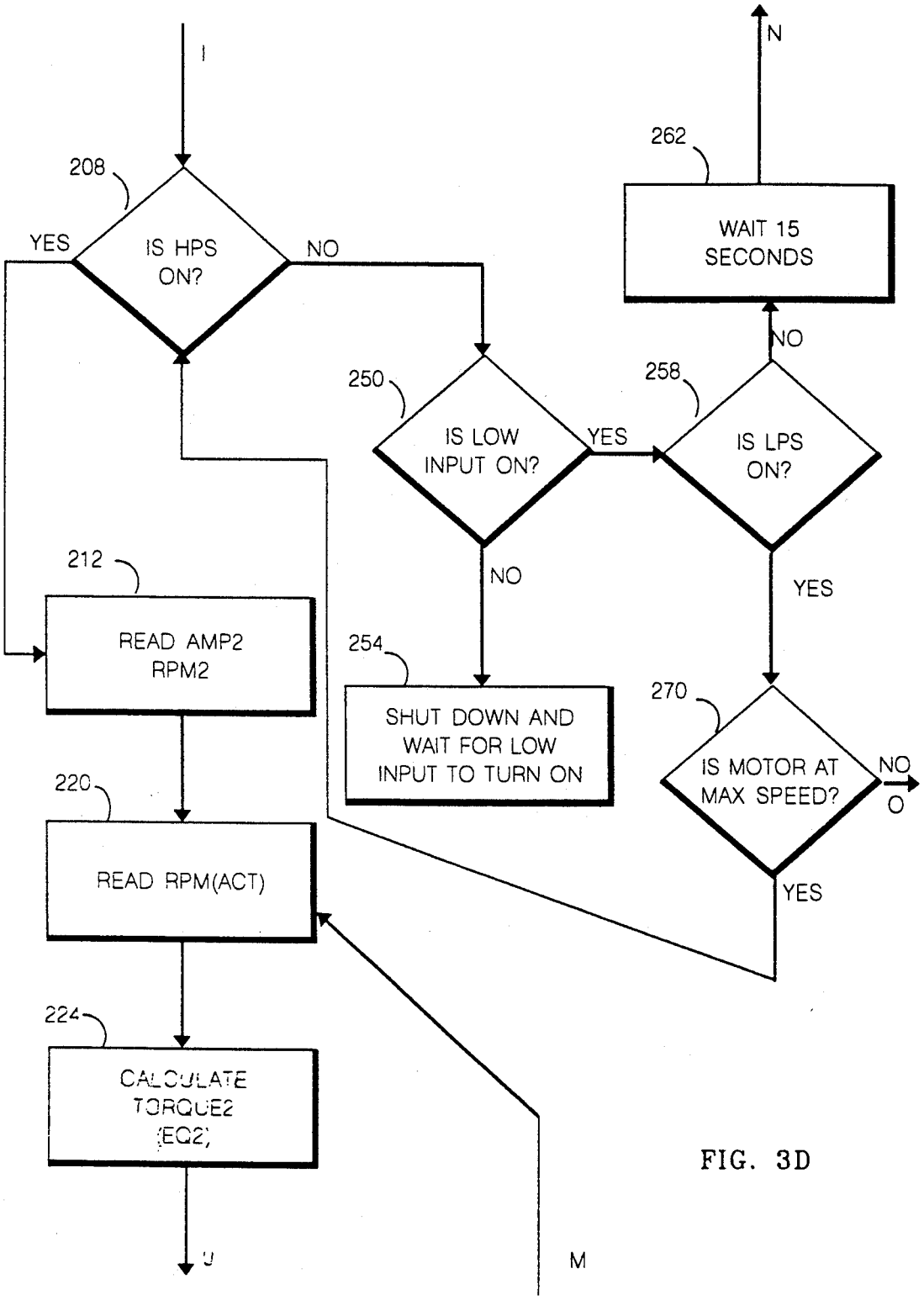
Figure 3E:
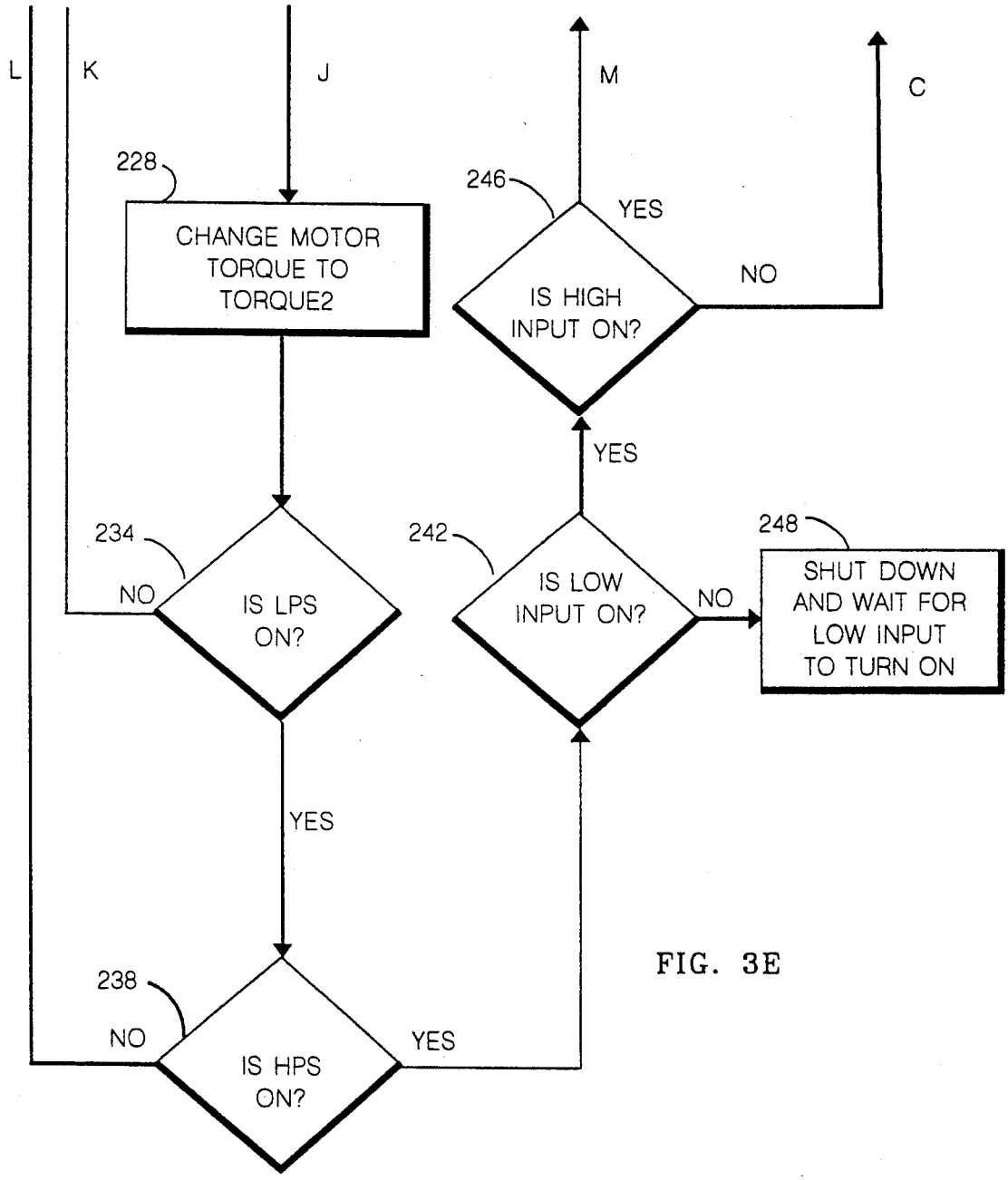

To aid in the control of excess air, a pair of pressure switches 31 and 32 are placed across burner box 12 and the collector box 16, respectively, so as to permit the measurement of the pressure drop across the heat exchanger system. The switches 31 and 32 are mechanically connected within the system to sense the exchanger pressure drop as shown in FIG. 2.

A burner box tube 33 leads from the pressure tap 36 and the collector box tube 34 leads from the pressure tap 37. Fluidly connected therebetween, in parallel relationship, are the low pressure switch 31 and the high pressure switch 32. The switches are calibrated to make, or close, at specific pressure differentials as determined in a manner which will be more fully described in U.S. Pat. No. 4,729,207. Switches that have been found satisfactory for use in this manner are commercially available from Tridelta as part numbers FS 6003-250 (High pressure) and FS 6002-249 (Low pressure).

Since the system normally operates under negative pressure conditions, it is necessary to fluidly connect the vent of gas valve 18 with tube 38 to tubes 33 and 39 via a "T" fitting 40 so as to reference low pressure switch 31, high pressure switch 32, and gas valve 18 to the negative pressure in burner box 12 while ICM inducer motor 24 is in operation.

Because the pressure drop across the heat exchangers is indicative of the level of excess air in the combustion system, the low and high pressure switches 31 and 32 are used to determine when the level of excess air falls above the minimum desired theoretical levels for low and high firing conditions, respectively.

Turning, now, to FIGS. *3a–3e*, the application of the instant invention to the operation of a two-stage furnace can be better understood. A call for heat is signaled by the low input turning on or activating, commonly as a signal from the furnace control board, at step 100. The system responds by having the ICM inducer motor 24, which has been idle, immediately step up to a rate of 3.0 oz.in., in step 102, and then accelerate at RATE1, which is 0.30 oz.in./sec., in step 104. Thereafter, in step 108 the system determines if the low pressure switch 31 (LPS) has turned on or been activated, usually from a 24 VAC input line. LPS 31 is set so as to be responsive to a pressure drop in the heat exchanger, which has been selected so as to be commensurate with a theoretically desired excess air level under low fire conditions.

If testing in step 108 shows that the LPS has not been activated, then low input activity is tested in step 136. If the low input is active then, in step 140 a determination is made as to whether either the high pressure switch (HPS) is active or the motor has reached maximum speed. If either is the case, then the LPS activity test of step 108 is redone. If, however, neither condition is met, then the system returns to step 104 to increase motor torque at RATE1.

Returning to the test of step 136, if the low input is not on, then ICM inducer motor 24 shuts down in step 156 and the system waits for a restart via the low input being turned on.

If the testing in step 108 shows that the LPS 31 is active, then in step 112 the microprocessor of the ICM inducer motor 24 records the values of AMP1 and RPM1. Next, in step 114, the actual RPM is read. The three values recorded are then used, in step 116, to calculate TORQUE1 as determined in Equation 1.

$$\text{TORQUE1} = \text{K1} * [(\text{AMP1} * \text{RPM1}/\text{RPM(act)}] + \text{K2} \qquad \text{Equation 1}$$

where: K1 and K2 are inducer wheel constants;

RPM1 is the inducer motor 24 speed when the low pressure switch makes;

AMP1 is the current when the low pressure switch makes; and

RPM(act) is the most recently measured RPM.

In the following step 120, the torque of the motor is changed (by acceleration or deceleration, as needed) to TORQUE1, thus maintaining constant CFM (cubic feet minutes of flow).

Thus, after AMP1 and RPM1 are recorded, the ICM inducer motor 24 will maintain constant CFM until the low input is deactivated or the high input is activated. The value of the CFM maintained will be some factor added to the CFM calculated from the known parameters.

If the LPS 31 is deactivated, as determined in step 124, the ICM inducer motor 24 waits 15 seconds in step 128, and then checks the low input in step 130. If the low input is off, the motor shuts down in step 131 and waits for the low input to be reactivated. If, on the other hand, the test of step 130 shows the low input on, the system returns to step 104 and the motor accelerates at RATE1. If the LPS 31 shows active in step 124, the system checks the status of high input in step 200.

If the high input is on, then the system moves into second stage operation, as will be discussed hereinafter. If the high input is not on, then in step 144 a test for the low input activity is performed. If it is not on, then in step 150, the ICM inducer motor 24 shuts down, and the system waits for a restart via the low input being turned on. If the low input is on, then the reading of actual RPM in step 114 is repeated.

Second stage operation is determined in step 200 by testing as to whether the high input line is activated. If found active, the ICM inducer motor 24 is ramped up in step 204 at RATE2, where: RATE2=0.15 oz.in./sec.

A test is next performed in step 208 to determine whether the HPS 32 has been activated, with the result that if it has not, the status of the low input is tested in step 250. If inactive, then the system, in step 254, shuts down and waits for the low input to turn on. HPS 32 is set to be responsive to a pressure drop in the heat exchanger, which has been selected so as to be commensurate with a theoretically desired excess air level under high fire conditions.

If, on the other hand, the test of step 250 shows that the low input is on, a check is made in step 258 to determine if LPS 31 is on. If not, the system waits 15 sec. in step 262 and then returns to test low input in step 266. If the results of the step 266 test show low input active, then the system resumes stage 1 activity at step 104. If low input is inactive then the motor shuts down and awaits restart in step 150.

Returning to the test of step 258, if the LPS is on, then a determination is made in step 270 as to whether the motor is at maximum speed. If it is, the HPS test of step 208 is performed; if it is not, the high input test of step 200 is performed.

Returning to the step 208 test for HPS activity, if the HPS is on, then AMP2 and RPM2 are recorded in step 212, and, in step 220 the actual RPM is recorded. These three values are used in step 224 to calculate TORQUE2 as determined by Equation 2:

$$\text{TORQUE 2} = \text{K1} * (\text{AMP 2} \times \text{RPM 2}/\text{RPM(act)} + \text{K2} \qquad \text{Equation 2}$$

where: K1 and K2 are inducer wheel constants

RPM2 is the inducer motor speed when the high pressure switch makes;

AMP2 is the current when the high pressure switch makes; and

RPM(act) is the most recently measured RPM.

In step 228, the torque of the motor is changed (by acceleration or deceleration, as needed) to TORQUE2, thus maintaining constant CFM (cubic feet minutes of flow).

The system next, in step 234, tests whether the LPS 31 is still active. If it is, the HPS activity is tested in step 238. If HPS is active, the low input activity is tested in step 242. If the results of this test are positive, then the high input activity is tested in step 246. If the high input is also on, then the value of the actual RPM is read in step 220 preliminary to recalculating TORQUE2 in step 224.

If the test of step 234 showed LPS to be inactive, control is returned to step 128 where the system waits 15 seconds and then returns to test low input in step 130.

If the test of step 246 shows the high input inactive, then the system returns to step 114, actual RPM is read.

If the test of step 242 shows the low input to be inactive, then the motor shuts down in step 248 and waits for the low input to be reactivated.

Returning to the test of step 238, if HPS is inactive then the system returns to step 204 with the motor torque increasing at RATE2.

It should be noted that the transition from second to first stage must be completed before a transition back to second stage can be initiated.

The first stage portion of the above described embodiment can be applied to a single stage fixed-firing rate induced draft furnace. This application is an extension of the method for controlling excess air as described in U.S. Pat. No. 4,703,747 to Thompson et. al and assigned to a common assignee. The teachings of the 4,703,747 patent are herein incorporated by reference as these teachings relate to the instant invention.

In order to practice the method of this invention the ICM inducer motor 24 must be capable of sensing the closure and opening of the low pressure switch, and the high pressure switch. Normally this would be done via sensing 24 VAC input signals.

An advantage of using this invention in a two stage fixed-firing rate induced draft furnace is that the complexity of the main furnace control can be reduced, resulting in reduced cost for furnace production.

Using this method provides improved combustion efficiency, independent of vent system design. The invention also allows the down-sizing of the vent system diameter because the ICM inducer motor is capable of operating at speeds far exceeding those of standard 2-pole motors. The ICM inducer motor would also be equipped with those input and output signals needed to achieve control using the method of U.S. Pat. No. 4,703,747.

When used in a mid-efficiency fixed-firing rate induced draft furnace, the method of the instant invention can allow side wall venting of the furnace, which is not normally achievable due to excessive vent and wind pressure variations. The instant invention allows adaptation to these varying conditions.

In addition, the inducer motor speed is reduced at the time of ignition, which significantly lowers burner sound levels at startup. This lessens the chance of the furnace noises waking or disturbing the occupants of the comfort zone being regulated by the furnace.

The equations applicable to calculate torque for these systems can be empirically determined using standardized systems by methods well known in the art.

In all applications this invention is an improvement over the prior art in that, while in operation, the actual RPM is being repeatedly determined and used to calculate the torque necessary to obtain the desired CFM. Changes in the air flow to the system, due to factors such as wind speed or partial obstruction of the intake vent, result in a change in the measured RPM, and the torque is recalculated accordingly. In the prior art, in contrast, once the RPM was set in a given firing mode, it remained the same until such time as a change was initiated which resulted in the motor turning off or the system moving to a different firing level.

While this invention has been explained with reference to the structure disclosed herein, it is not confined to the details set forth and this application is intended to cover any modifications and changes as may come within the scope of the following claims:

What is claimed is:

1. In a fixed-firing rate induced draft furnace, having a heat exchanger and an integrated control inducer motor, an improved method of controlling excess air comprising the steps of:

providing at least one pressure switch that is responsive to a preselected pressure drop level in the heat exchanger, said pressure drop level being selected so as to be commensurate with a theoretically desired excess air level under firing operating conditions;

accelerating said integrated control inducer motor until said pressure switch closes and thereupon recording a first motor speed and a first current level;

calculating a first torque value based on said first motor speed and said first current level using the equation:

TORQUE 1=K1 * [AMP * RPM1/RPM (act.)]+K2 where: K1 and $K_2$ are inducer wheel constants;

RPM1 is the inducer motor speed when a low pressure switch makes;

AMP1 is a current measurement when the low pressure switch makes; and RPM (act) is a most recently measured RPM; and maintaining a constant CFM by controlling the torque applied to said integrated control inducer motor in accordance with said first torque value.

2. The method of claim 1 comprising the further steps of:

recording most recent motor speed;

calculating a current torque value based on said first motor speed, said first current level and said most recent motor speed;

maintaining a constant CFM by controlling the torque applied to said integrated control inducer motor in accordance with said current torque value.

3. The method of claim 1 wherein said calculating is performed by a microprocessor integral to said integrated control inducer motor.

4. The method of claim 1 wherein said furnace is a single-stage furnace having a single pressure switch.

5. In a fixed-firing rate induced draft, two-stage furnace, having a heat exchanger and an integrated control inducer motor, an improved method of controlling excess air comprising the steps of:

providing a low pressure switch that is responsive to a selected first pressure drop level in the heat exchanger, said first pressure drop level being selected so as to be commensurate with a theoretically desired excess air level under low fire conditions;

providing a high pressure switch that is responsive to a selected second pressure drop level in the heat exchanger, said second pressure drop level being selected so as to be commensurate with a theoretically desired excess air level under high fire conditions;

upon determination that a call for heat exists:

accelerating the integrated control inducer motor at a first rate until said low pressure switch closes and recording a first motor speed and a first current level at that time;

determining whether a request for operation under high fire condition exists;

if a request for operation under high fire condition does not exist:

(1) calculating a first torque value based on said first motor speed and said first current level using the equation:

TORQUE 1=K1 * [AMP * RPM1/RPM (act.)]+K2 where: K1 and $K_2$ are inducer wheel constants;

RPM1 is the inducer motor speed when a low pressure switch makes;

AMP1 is a current measurement when the low pressure switch makes; and RPM (act) is a most recently measured RPM; and (2) maintaining a constant CFM by controlling the torque applied to said integrated control inducer motor based on said first torque value; and if a request for operation under high fire condition exists:

(3) accelerating the integrated control inducer motor at a second rate until said high pressure switch closes and recording second motor speed and second current level at that time;

(4) calculating a second torque value based on said second motor speed and said second current level; and (5) regulating torque applied to said integrated control inducer motor based on said second torque value.

6. The method of claim 5 comprising the further steps of:

recording most recent motor speed;

under low fire condition:

(1) calculating a first current torque value based on said first motor speed, said first current level and said most recent motor speed;

(2) regulating torque applied to said integrated control inducer motor in accordance with said first current torque value and;

under high fire condition:

(1) calculating a second current torque value based on said second motor speed, said second current level and said most recent motor speed; and (2) maintaining a constant CFM by controlling the torque applied to said integrated control inducer motor in accordance with said second current torque value.

* * * * *